United States Patent [19]

Swearingen et al.

[11] 4,173,870

[45] Nov. 13, 1979

[54] CONTROL SYSTEM AND METHOD

[76] Inventors: Judson S. Swearingen; Leendert A. Beeloo, both of 2235 Carmelina Ave., Los Angeles, Calif. 90064

[21] Appl. No.: 875,183

[22] Filed: Feb. 6, 1978

[51] Int. Cl.[2] ..... F01D 17/00

[52] U.S. Cl. ..... 60/702; 60/719; 60/327; 60/DIG. 2

[58] Field of Search ..... 60/327, 328, 420, 426, 60/698, 700, 701, 702, 706, 707, 715, 719, DIG. 2; 416/35

[56] References Cited

U.S. PATENT DOCUMENTS

| | | | |
|---|---|---|---|
| 1,937,349 | 11/1933 | Kieser | 60/719 X |
| 2,204,138 | 6/1940 | Knowlton | 60/715 X |
| 3,812,377 | 5/1974 | Malone | 60/719 X |

*Primary Examiner*—Edgar W. Geoghegan
*Attorney, Agent, or Firm*—Browning, Bushman & Zamecki

[57] ABSTRACT

Disclosed are apparatus and methods for controlling parameters of fluid-driven systems. A control unit of the invention compares an input control signal to a tachometer signal from a fluid-driven turbine to produce a flow signal for controlling the turbine speed. The speeds of turbines in series are linked by the tachometer signal of the first turbine acting as the control signal for the following turbines. A critical speed interval is identified in relation to a range of values of the control signal. As the speed of a turbine is increased or decreased, its control unit holds the turbine speed at the limit of the critical speed interval, then rapidly accelerates the turbine through the interval to avoid prolonged operation at the turbine's critical speed. The individual critical speeds of separate turbines in series may be accommodated by critical speed intervals defined in separate control units for each of the turbines. Multiple critical speeds for a given turbine may also be provided for by defining multiple critical speed intervals within the corresponding control unit.

31 Claims, 1 Drawing Figure

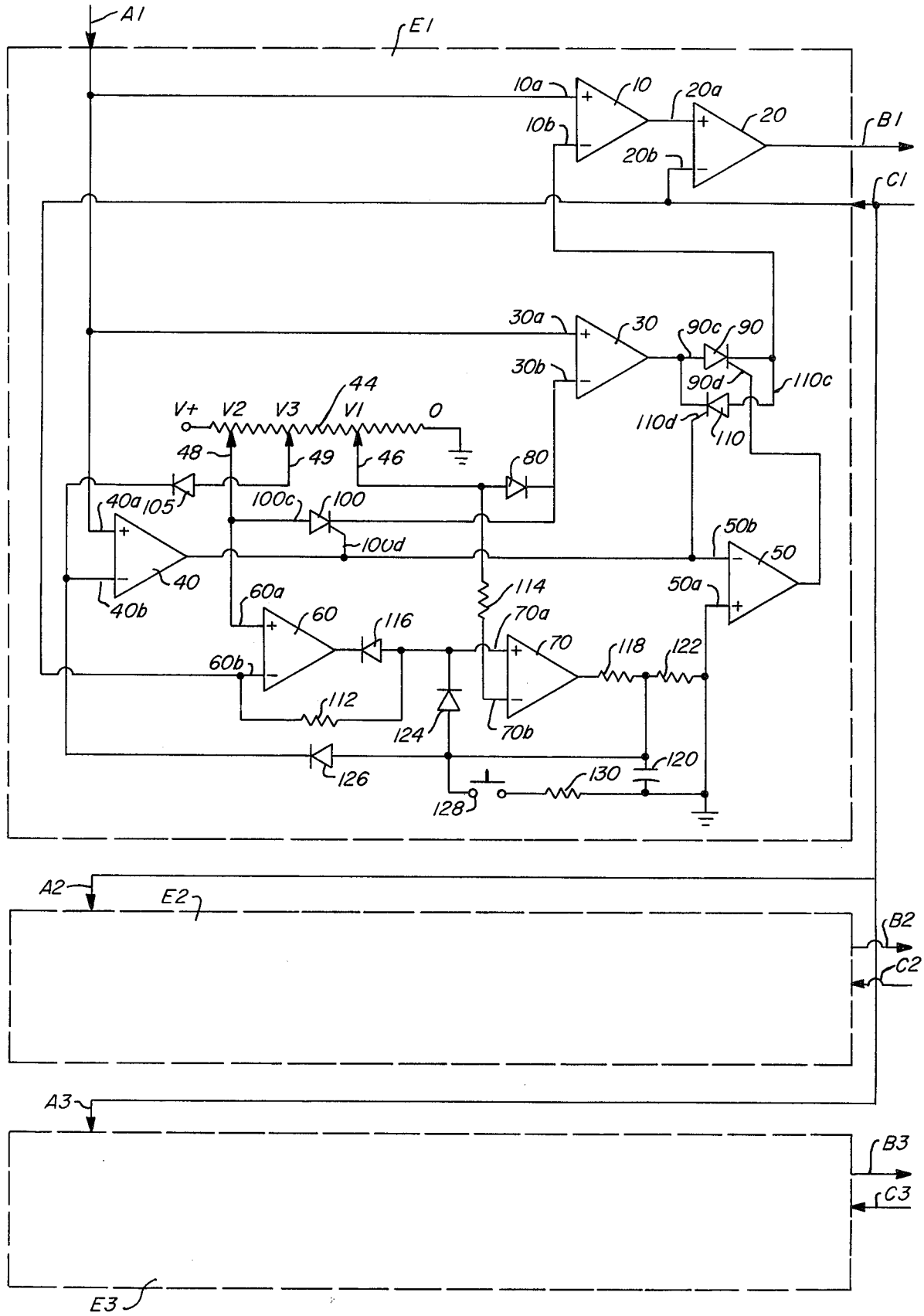
A1
E1
10a
10
20a
20
10b
20b
B1
C1
30a
30
90c
90
30b
90d
110c
44
V+
V2
V3
V1
0
110d
110
48
49
46
80
40a
105
100c
100
100d
50b
50
40
40b
60a
60
116
114
70a
70
118
122
50a
60b
112
124
70b
126
120
130
128
A2
E2
B2
C2
A3
B3
C3
E3

CONTROL SYSTEM AND METHOD

BACKGROUND OF THE INVENTION

1. Field of the Invention

The present invention pertains to control of fluid flow. More particularly, the present invention is related to methods and apparatus for control of fluid used to drive and operate a system, or a plurality of systems wherein the systems are interdependent. The methods and apparatus of the present invention find application in the control of the flow of driving fluid through turbines, particularly systems of two or more turbines operating in series.

2. Description of Prior Art

Modern turbines are generally equipped with primary nozzles whose cross sectional areas may be selectively varied to control the flow of the driving fluid through the turbines. For a given drop in pressure of driving fluid across a single turbine, the volume flow of driving fluid and, hence, the energy transferred to the turbine, increase as the nozzle is opened, and the speed of the turbine is increased. The load driven by the turbine also influences its speed, causing the speed to decrease as the load is increased.

When two or more turbines are operated in series, the total drop in driving fluid pressure is distributed, in general, among all such turbines. Thus, a change in the pressure drop across one nozzle, effected by a variation in opening of that nozzle, affects the pressure in the driving fluid supply line in general, and, therefore, the pressure drop across all the other turbine nozzles. Opening the nozzle of one turbine in a series reduces the pressure drop across that turbine, slowing it down, and increases the pressure drop across the other turbines, speeding them up. Thus, the relative speeds of turbines in series are determined by the relative degree by which each turbine's nozzle is open or closed. Thus, in general, for like turbines with equal loads, if all nozzles are open, say, 40%, all turbines run at the same speed. If the nozzle of one such turbine in the series is open 80%, that turbine will be running at approximately half the speed of the turbines with nozzles open 40%. As in the case of a single turbine, varying loads on the individual turbines cause the respective turbine speeds to vary also.

The customary method of adjusting turbine speeds for a series of turbines is to manually preset the relative degree of opening of the several turbine nozzles, then to effect all speed adjustments during turbine operation en-masse, by a single flow signal to all the nozzle actuators. Thus, for example, certain turbines in the series may be preset to operate at one-half the speed of the remaining turbines by manually adjusting their respective nozzles accordingly. Then, during operation, regardless of the actual speeds involved, the first set of turbines will operate at one-half the speed of the second set. This ratio of speeds will be preserved as the flow signal is used to increase or decrease the speeds of all the turbines by decreasing or increasing, respectively, the openings of the turbine nozzles. However, once the nozzle ratio is manually preset, it must be manually adjusted again to accommodate any changed conditions concerning one or another of the turbines of the series.

Another concern in varying the speed of turbines is the critical speed associated with the resonant frequency in a component of the individual turbine. For a given turbine, there may be one or more speeds of operation at which the frequency of rotation of the rotor corresponds to such resonant frequency such that continued operation at that speed may result in severe vibration and ultimate damage to the turbine. Such critical speeds are generally encountered at something less than the range of normal operating speeds. Consequently, it is common practice, in starting up a turbine, to manually bring the turbine up to a speed just under the critical speed, then to quickly accelerate the turbine through the critical speed. Similarly, in slowing down a turbine, the critical speed is approached from above by manual control, and the turbine rapidly decelerated through the critical speed.

It will be appreciated that maneuvering all the turbines coupled in a series through their respective critical speeds, as described hereinbefore, can be a tedious and unreliable operation. Whether in a series of turbines or in the case of a sole turbine, the reliance on manual control to avoid critical turbine speed is generally undependable since a turbine may be inadvertently be operated at its critical speed for a period of time sufficient to result in turbine damage. The problem may be compounded where a given turbine exhibits more than one critical speed.

SUMMARY OF THE INVENTION

The method of the present invention is applicable to control fluid-driven systems in general, particularly when such systems are controllable through selectively adjustable nozzle devices through which the driving fluid is communicated. A control signal is provided for controlling the speed of operation of such a system. A speed signal, which may be generated by use of a tachometer, is a measure of the speed of operation of the system. A flow signal is produced for communication to the nozzle device, or any actuator used in conjunction therewith, to control the adjustment of the nozzle to bring the speed of operation of the system into line to correspond to the value of the control signal.

When the system to be controlled includes individual fluid-drive systems, arranged to operate in series, the first system in the series may be controlled by a control signal as described hereinbefore. The speed signal for the first system in the series is then used as the control signal for the systems following in the series. In this way, all of the individual systems have their speeds adjusted to coincide with that of the first system, although a separate flow signal, based upon a corresponding speed signal, is generated to directly control each individual system in the series.

To avoid prolonged operation of an individual system at a speed of operation corresponding to the resonant frequency of that system, a critical speed interval, identified by a first limiting value for the control signal and a second limiting value for the control signal, may be identified. An intermediate control signal value, between the first and second limiting signal values identifying the limits of the critical speed interval, is also identified. As the control signal is increasing or decreasing to adjust the speed of operation of the system accordingly, a protecting signal is generated whenever the value of the control signal falls within the limiting values used to define the critical speed interval. When the control signal value, within the critical speed interval, lies below the value of the intermediate control signal value, the value of the protecting signal generated is determined by the difference between the first limiting signal value and the actual control signal value.

Whenever the value of the control signal falls between the intermediate control signal value and the second limiting signal value, the value of the protecting signal is determined by the difference between the second limiting signal value and the actual control signal value. The protecting signal is compared with the control signal value, and the difference between these two signals is compared with the speed signal value. The result of the latter comparison is amplified and communicated to the nozzle device of the system as the flow signal for determining the speed of rotation of the turbine rotor.

A timing circuit is provided to generate a timing signal to operate whenever the rotor speed, as evidenced by the tachometer signal, has not accelerated quickly enough through the critical speed interval after the control signal was increased to exceed the intermediate control signal value. Then, the timing signal causes the protecting signal to be again determined based on the first limiting value rather than the second limiting value. This results in the flow signal being reduced to slow the rotor to the lower limit of the critical speed interval. The timing circuit also locks the system in this configuration.

The first and second limiting values may be so determined to define the critical speed interval large enough to accommodate multiple critical speeds exhibited by a turbine. Also, two or more critical speed intervals, each providing a separate protecting signal, may be defined where the critical speeds of the turbine are too widely separated in values for a practical, single critical speed interval to include all the critical speeds.

The present invention finds particular application to fluid-driven turbines, especially a plurality of such turbines arranged to operate in series. Then, the speed, or tachometer, signal from the first turbine is communicated as a control signal to each of the control units for the turbines following the first turbine in the series. Thus, by selectively adjusting the first control signal to the control unit of the first turbine in the series, the speeds of all the turbines in the series may be controlled.

The control units for all of the turbines in the series may be essentially the same. Thus, a control signal and a speed, or tachometer, signal, generated to correspond to the speed of operation of the corresponding turbine, are received. A critical speed interval, identified by a first limit signal value and a second limit signal value, and including an intermediate control signal value is determined. A protecting signal is generated whenever the incoming control signal value falls within the critical speed interval. This protecting signal, whose value is determined as described hereinbefore, is then compared with the control signal to produce a difference signal. This difference signal is then compared with the tachometer signal from the corresponding turbine, and a result of this comparison a flow signal is generated for controlling the nozzle of the turbine. A timing circuit prevents prolonged operation of the turbine within the critical speed interval as the rotor speed is being increased by returning the protecting signal to the lower limit value if the rotor does not respond quickly enough to the control signal value exceeding the intermediate control signal value. Each such control unit may have as many such critical speed intervals defined as required to accommodate multiple critical speeds for the corresponding turbine.

These features of the control unit for a turbine in a series are applicable to controlling a sole turbine by use of a similar control unit. The primary difference between operating a sole turbine by such a control unit and operating a series of turbines, as described hereinafter, lies in the fact that the control signal for the turbines following the first turbine in a series are obtained from the tachometer signal of such first turbine, and in the manner in which the flow signals for the turbines following the first turbine in the series adjust the nozzles of such following turbines.

The apparatus of the present invention includes a control unit for receiving a control signal and for producing a flow signal for communication to a nozzle device on a turbine. Signal generation means are provided for producing a tachometer signal proportional to the speed of operation of the turbine. The control unit includes a first signal processing portion for comparing the control signal with a protecting signal from a second signal processing portion of the control unit. The second signal processing portion, or protector circuit, compares the control signal with a critical signal value range defined by a first limit value and a second limit value. An intermediate signal value between such first and second limit values is also predetermined. The second signal processing portion operates to produce the protecting signal whenever the control signal valve falls within the critical signal value range. The first signal processing portion produces a flow signal based on the difference between the tachometer signal and the comparison of the control signal and the protecting signal. The flow signal is communicated to the turbine to selectively adjust the nozzle device to control the speed of operation of the turbine.

For a given turbine, the control unit may be adjusted to define a critical speed interval which includes the critical speed of the turbine, that is, the speed of operation of the turbine corresponding to the resonant frequency of a turbine component. The intermediate control signal value is then selected preferably at a value midway through the critical speed interval. Then, as the control signal is increased to increase the speed of operation of the turbine, the turbine speed will be held constant as the control signal value is varied in the lower portion of the critical speed interval between the first limit value and the intermediate signal value. Then, as the control signal value exceeds the intermediate signal value, while it remains in the critical speed interval, the speed of operation of the turbine is rapidly accelerated to a value corresponding to the upper limit of the critical speed interval. As the control signal value then exceeds the upper limit value, the speed of operation of the turbine will increase accordingly as the control signal value continues to increase. When the control signal is decreased from a value above the critical speed interval, the procedure is generally reversed. Thus, as the control signal is reduced through the critical speed interval, the speed of operation of the turbine is held at the upper limit of the critical speed interval until the value of the control signal falls below that of the intermediate control signal value. Then, the speed of operation of the turbine is rapidly decreased to the lower limit of the critical speed interval where it is held until the control signal value is further decreased to a value below the critical speed interval. In this way, prolonged operation of the turbine at its critical speed, which falls within the critical speed interval, is avoided.

A timing circuit is provided as part of the protector circuit. As the turbine speed is being increased, and the control signal is made to exceed the intermediate control signal value, if the rotor speed does not accelerate through the critical speed interval rapidly enough, the timing circuit causes the protector circuit to adjust to return the flow signal value to that corresponding to the lower limit of the critical speed interval. The protector circuit is also locked into this configuration by the timing circuit.

Where a turbine exhibits multiple critical speeds, the protector circuit may be provided to define a critical speed interval large enough to include the multiple critical speeds. Also, multiple protector circuits may be arranged in parallel to define individual critical speed intervals, identified by separate sets of limit signal values. Then each such protector circuit generates a separate protecting signal, operable to affect the flow signal whenever the control signal falls within the range of the limit signal values of the corresponding protector circuit.

With turbines arranged to operate in series, the control unit for each turbine is adjusted to feature a critical speed interval which includes the critical speed of the related turbine. Thus, although the speeds of operation of the turbines taken as a group are generally increased or decreased together, the procedure described hereinbefore for avoiding the critical speed of an individual turbine is followed in each case. As will be discussed in more detail hereinafter, adjusting the nozzle device of one such turbine in the series affects the speeds of operation of the other turbines in the series. Thus, as one turbine is held at a constant speed at the lower limit of its critical speed interval as the turbine speeds are being increased, for example, the other turbines are continually adjusted to increase their speeds. Then, as the control signal to the turbine being held at constant speed reaches the intermediate value of its corresponding critical speed interval, that turbine's speed rapidly increases. This rapid rise in speed of the turbine originally held at constant speed significantly affects the speeds of operation of the other turbines in the series. Consequently, there is a brief period during which the speeds of operation of all the turbines in the series must swing into coincidence. These significant swings in speeds of operation are diminished with the use of the intermediate control signal value. Thus, a particular turbine undergoes the rapid change in speed of operation before its control signal is required to traverse the complete critical speed interval, thereby decreasing the deviation in speeds of operation among the turbines in the series that must be accommodated.

It will be appreciated that the present invention provides a system for controlling turbines in series which senses the speed of each turbine and adjusts the relative settings of the nozzle devices of all the turbines to tend to maintain all turbines in the series at the same proportional speeds. Furthermore, the control system of the present invention is selectively operable by controlling the value of a single, first control signal. The present invention also provides a control system with the capability of avoiding certain speed intervals for all turbines so controlled. Finally, the three significant values related to the critical speed intervals, namely, the two limiting control signal values and the intermediate control signal value, are all adjustable so that the critical speed interval may be provided at any speed, and the interval itself may be of any extent.

BRIEF DESCRIPTION OF THE DRAWING

The FIGURE is a schematic illustration of the control system of the present invention as applied to a series of three turbines.

DESCRIPTION OF PREFERRED EMBODIMENTS

Apparatus of the present invention is shown schematically in the FIGURE. Each of the dashed enclosures E1, E2, and E3 represents a unit of the control system of the present invention. The control units E1, E2, and E3 are linked to control the flow of driving fluid through turbines 1, 2 and 3, respectively, (not shown) which are arranged in series. Since such control units may be essentially alike, in both construction and operation, only the control unit E1 for turbine 1 is shown and described in detail, and control units E2 and E3 are assumed, for purposes of discussion, to be similar in construction and operation to control unit E1. Also, it will be appreciated that the system and method of the present invention may be applied to any number of turbines and control units.

For simplicity and clarity, signals and signal values are identified herein by the same notation of their respective locations in the circuitry.

A first control signal is received by the first control unit E1 at input A1. Second and third control signals are received by control units E2 and E3 at A2 and A3, respectively. An output flow signal at B1, generated by the first control unit E1, is communicated to the actuator of the nozzle of turbine 1 (not show). Similarly, control units E2 and E3 generate output flow signals B2 and B3, which are communicated to the nozzle actuators of turbines 2 and 3 (not shown), respectively. Each turbine is equipped with a tachometer which generates a signal proportional to the rotor speed of the corresponding turbine. The tachometer, or speed, signals from the turbines 1, 2 and 3 are fed to the control units E1, E2, and E3 at C1, C2, and C3, respectively. The first turbine tachometer signal C1 also serves as the second and third control signals, A2 and A3, respectively, as indicated in the FIGURE.

The first control unit E1 includes seven voltage difference amplifiers 10, 20, 30, 40, 50, 60 and 70. The output of each difference amplifier is a signal proportional to the voltage at the positive input less the voltage at the negative, or reference, input of the difference amplifier, with the proportionality factor being the amplification factor of the difference amplifier. Where the amplification factor is unity, the difference amplifier functions as a subtractor, and the output signal is equal to the difference between the two input signals. Signals to the seven positive inputs are hereinafter indicated with a label including the mark "a", while "b" is used in conjunction with the negative inputs.

The first control signal A1 is communicated to the positive input **10*a* of the difference amplifier 10. A reference signal, a "protecting signal" discussed in detail hereinafter, is communicated to the negative input 10*b* of the same difference amplifier 10. The difference amplifier 10 is a subtractor. Hence, the output signal from difference amplifier 10, equal to input voltage 10*a* less reference voltage 10*b*, is fed to the positive input 20*a* of the difference amplifier 20. The first tachometer signal C1 is communicated to the negative input 20*b*. The amplification factor of the difference amplifier 20 is large, say, twenty. Thus, for example, the output signal from the difference amplifier 20 is twenty times the difference of the input signal 20***a* less the tachometer signal 20*b*. This output signal from difference amplifier 20 is B1, which controls the nozzle actuator of turbine 1 as noted hereinbefore.

The first control signal A1 is also fed to the positive input 30*a* of the difference amplifier 30, which is also a subtractor. A resistor 44 is equipped with two adjustable contacts 46 and 48, and a "center tap" 49. A voltage V is impressed across the resistor 44, as indicated in the FIGURE, by an appropriate power supply (not shown), and the contacts 46 and 48 are positioned to provide voltage signals V1 and V2, respectively, where V2 is greater than V1. The tap 49 provides a voltage V3 between V1 and V2. The impressed voltage V and the contacts 46 and 48 are adjusted so that the voltages V1 and V2 correspond to a critical speed interval for turbine 1, containing that turbine's critical speed, and so that the voltage V3 at tap 49 falls about midway between the values V1 and V2, corresponding, therefore, to a speed at about the midpoint of the critical speed interval. The voltage V1 may then be communicated, through a diode 80, to the negative input 30*b* of the subtractor 30, whose output is communicated, through a silicon controlled rectifier (SCR) 90, as the protecting signal 10*b* to difference amplifier 10. The voltage signal V2 is communicated to a silicon controlled rectifier 100. The output of SCR 100 is fed to reference input 30*b* of the subtractor 30.

As is well known in the art, diodes, such as 80, transmit positive voltage signals in only a forward direction. Similarly, SCR's, such as 90 and 100 herein, transmit positive signals in only a forward direction when closed, or enabled, by a sufficiently large gate, or trigger signal. Otherwise, without such a positive trigger signal present, the SCR is open, and passes no signal. Thus, for example, a signal 100*c* may be passed by the SCR 100 only when a sufficiently large positive trigger signal 100*d* is applied thereto. Then, the diode 80 prevents a large output voltage from SCR 100 from being impressed on the resistor 44 at contact 46, but does feed the voltage V1 from the contact 46 to the subtractor input 30*b* when SCR 100 is open.

The voltage V3 at the resistor tap 49 is fed through a diode 105 and serves as a reference signal 40*b* of the difference amplifier 40. The first control signal A1 is fed to the positive input 40*a* of that amplifier. The amplification factor of the difference amplifier 40 is large, say twenty. The output of amplifier 40 serves as the gate 100*d* for SCR 100, as well as the gate 110*d* for a third SCR 110. SCR 110 is arranged with its input 110*c* connected in common with the output of the SCR 90. While a negative output from the subtractor 30 will be blocked by SCR 90, such a signal will be effectively passed by SCR 110, when closed, to appear at input 10*b*. Thus, the protecting signal 10*b* at the difference amplifier 10 may be passed from the subtractor 30 if positive by the SCR 90, if closed, or if negative by the SCR 110, if closed.

The closing of SCR 90 to allow passage of a positive input signal 90*c* is controlled by a positive trigger output signal 90*d* from the difference amplifier 50, which also features a large amplification factor. The output from the difference amplifier 40 serves as the reference input 50*b* of the difference amplifier 50, while the input to the positive terminal 50*a* is set at ground zero. Thus, the difference amplifier 50 provides a positive trigger signal 90*d* to close SCR 90 as long as the reference signal 50*b* is negative, which is the case whenever the voltage V3 exceeds the first control signal A1.

The first tachometer signal C1 serves as the reference signal 60*b* of the difference amplifier 60, and communicates through a resistor 112 to the positive input 70*a* of the difference amplifier 70. The voltage V2 is the positive input signal 60*a* of the difference amplifier 60, while the voltage V1 is fed through a resistor 114 to the negative input 70*b* of the amplifier 70.

The amplification factor of the difference amplifier 60 may be unity, while that of the difference amplifier 70 is large. The output of amplifier 60 is fed, in the reverse direction, to a diode 116. Thus, as long as the first tachometer signal C1 is less than the voltage V2, the output of the amplifier 60 is blocked by the diode 116, and the input signal 70*a* to the amplifier 70 may be just the signal C1 fed through the resistor 112. Once the value of the signal C1 exceeds the voltage V2, the output from the difference amplifier 60 is a negative signal which may be passed by the diode 116.

When the first tachometer signal C1, as passed through the resistor 112 to the input 70*a*, exceeds the voltage V1, the difference amplifier 70 feeds an amplified, positive voltage output to a resistor 118 to charge a capacitor 120. The large amplification factor of the difference amplifier 70 results in the maximum voltage capability of the capacitor 120 being reached in a short selected period of time. This maximum voltage should be substantially higher than the maximum possible value of the first control signal A1 for a purpose described hereinafter.

A resistor 122 forming a T with the capacitor 120 and the resistor 118 cooperates with the capacitor and the resistor 118 to enable the capacitor to be charged to a value of voltage equal to V3 in a few seconds and soon thereafter to exceed the value of voltage V2. This combination of the capacitor 120 and the resistors 118 and 122 serves as a timer, supplying a time signal in the form of a voltage charge. The timing may be interrupted by the capacitor voltage being discharged through a diode 124 and the diode 116 by a negative output signal from the difference amplifier 60 any time its reference voltage 60*b*, that is, the first tachometer signal C1, exceeds the value of voltage V2, input to the positive terminal 60*a*. If the capacitor 120 is not thus discharged, and its voltage voided before it exceeds the value of the control signal A1, SCR 100 is opened, allowing the voltage value V2 to be impressed at the input 30*b* of the difference amplifier 30, which returns the speed of the turbine to the lower limit of the critical speed interval, as follows. The capacitor voltage is communicated through a diode 126 to the reference input 40*b* of the difference amplifier 40, but is prevented from being impressed on the resistor 44 tap 49 by the diode 105. The capacitor 120 and the resistors 118 and 122 are designed for timed charging of the capacitor 120. If the capacitor voltage exceeds the value of the control signal A1, a resulting negative output of difference amplifier 40 causes SCR's 100 and 110 to be opened, which results in a positive output voltage from the difference amplifier 50. Under these conditions, the reference signal to the difference amplifier 30 is returned to the voltage level V1, and SCR 90 is closed to allow voltage V1 to control the turbine rotor speed through the difference amplifier 30.

The charge voltage of capacitor 120 is impressed, through the diode 124, on the input 70*a* of the difference amplifier 70. This feedback of the discharge signal from the capacitor 120 has the effect of maintaining, or locking in, the time signal to the reference input 40b of the difference amplifier 40. A push-button switch 128 may be closed to discharge the capacitor 120 through a bleeder resistor 130, thus "unlocking" the time signal and freeing the difference amplifier 40 for a renewed attempt to bring rotor speed above critical speed before capacitor 120 is charged.

The apparatus and method of the present invention may be appreciated by a consideration of the operation of the control system as the turbines are started up, then shut down.

Consider first the case of a single turbine, operated by control unit, E1, with no control signals A2 and A3 being transmitted. With the rotor of turbine 1 stationary, the control signal A1 is provided as a low voltage, impressed at inputs 10a, 30a and 40a. With the signal at 30a less than that at 30b, which then has the value V1 (SCR 100 is open), subtractor 30 has a negative output, which is not passed by SCR 90 because an SCR will not pass a negative signal in the forward direction. Similarly, the signal 40a is less than the reference signal 40b, which has the value V3. Thus, the output from the difference amplifier 40 is negative, and, therefore, SCR's 100 and 110 are open. Consequently, the protecting signal at 10b is isolated and therefore zero. However, SCR 90 is closed due to the positive output of amplifier 50 impressed at 90d.

With both 10b and 20b zero, the output of subtractor 10 is the voltage 20a, which has the value of signal 10a, and which is then amplified by difference amplifier 20 to a high output flow signal B1. The flow signal B1 opens the nozzle of turbine 1 to cause the rotor to turn. As the rotor picks up speed, the tachometer signal C1, applied to difference amplifier 20 at 30b, increases, thereby reducing the output signal of the difference amplifier 20, that is, the flow signal B1. If the tachometer signal C1, reflecting the speed of the rotor of turbine 1, were to equal 20a, the flow signal B1 would go to zero. However, as the rotor slows, the tachometer signal C1 also reduces, causing B1 to increase. Furthermore, due to the large amplification factor of the difference amplifier 20, a voltage will be maintained at B1 by even a small difference in the signals 20a and 20b. Thus, the control system rapidly adjusts, the maintains turbine speed so that the tachometer signal is very near the value of the control signal A1. A change in the value of control signal A1 causes an adjustment in the rotor speed to bring the tachometer signal C1 to again nearly equal A1.

As soon as the control signal A1 exceeds V1, the subtractor 30 outputs a positive signal, which is passed by the closed SCR 90 to 10b as the protecting signal. The value of C1, the reference signal at 20b, is then essentially equal to V1. Since the amplification factors of the subtractors 10 and 30 are equal, that is, unity, the output of subtractor 10, which is just the difference between the input signal 10a and the protecting signal 10b from the subtractor 30, is equal to the voltage V1. As the value of signal A1 is thereafter increased, and with the values 10a and 30a always equal to A1, the protecting signal 10b increases at the same rate. Consequently, the value of the output signal 20a is constant at V1, and the flow signal B1 from the difference amplifier 20 remains the same although the value of A1 increases. This causes the speed of the rotor and, hence, the tachometer signal C1 to remain constant.

As the value of the control signal A1 exceeds V3, the input 40a of difference amplifier 40 exceeds the reference signal 40b, and a positive trigger signal is fed to SCR's 100 and 110, closing these rectifiers. This same positive signal at 50b creates a negative output signal from difference amplifier 50 and this output signal opens SCR 90. As soon as SCR 100 is closed, the higher voltage V2 is applied at 30b, resulting in a negative signal from the subtractor 30. While this negative output signal will not pass through SCR 90, closed SCR 110 will pass the signal as a negative reference voltage at 10b. The sudden application of the negative signal at 10b causes a sudden increase in the value of the output signal 20a to the value of V2, resulting in a substantial increase in the flow signal B1, which immediately results in an increase in rotor speed. As the rotor speed thus increases, the reference signal 20b for the difference amplifier 20 also rises in value, with consequent reduction of the output signal B1. As the value of B1 decreases in response to the approach of 20b to 20a in value, the tachometer signal C1 also decreases. These variations in 20b and B1 continue until the rotor speed again stabilizes corresponding to a control signal equal to V2.

As the control signal A1 is further increased beyond the value of V3, the input 30a increases, approaching the higher value V2 at 30b. Thus, the output signal from the subtractor 30, still passed by SCR 110 to the input 10b, becomes less negative. At the same time, the input 10a increases. In view of the similarity of the subtractors 10 and 30, the two signals 10a and 10b again rise at the same rate, resulting in signal 20a, and, therefore, output flow signal B1, each remaining constant.

When the control signal A1 equals the voltage V2 corresponding to the upper limit of the critical speed interval, the signal 30a equals 30b, and the output signal from subtractor 30 is zero. Further increase of the value of A1 beyond the voltage V2 causes the input signal 30a to exceed the reference signal 30b, and the output of subtractor 30 to be positive. Thus, the protecting signal 10b increases from a negative value to zero as the value of the control signal A1 approaches, then equals, V2. For all values of the control signal A1 greater than V2, the output of the subtractor 30 is positive. However, this signal cannot pass (in reverse direction) through SCR 110, and SCR 100 is open. Therefore, the reference signal 10b remains zero. Therefore, as the control signal A1 is further increased above the value V2, the input 10a increases with the reference voltage 10b remaining zero, thereby increasing the signal at 20a, and increasing the output signal B1 to increase the rotor speed. As the rotor speed increases, the tachometer signal C1 increases, following the control signal A1. If the control signal A1 is set on a specific value, the turbine speed ultimately stabilizes, as described hereinbefore, with the value of C1 approaching that of A1.

At values of the control signal A1 above V2, nothing further happens regarding the protecting signal. The input signal 40a continues to exceed 40b, maintaining a positive output from the difference amplifier 40 to keep the SCR's 100 and 110 closed and SCR 90 open through differential amplifier 50 as explained hereinbefore. The signal 10b remains zero.

On reduction of speed of the turbine by decrease of the control signal A1, the previously described procedure generally reverses. As the control signal A1 is reduced from a value greater than V2, the tachometer signal C1 follows it down until the control signal reaches the value V2. At that point, the protecting signal 10b is zero. When the value of control signal A1 becomes less than V2, the value of input signal 30*a* falls below 30*b* and results in a negative output signal from 30. SCR 110 is still closed, so this negative protecting signal is communicated through SCR 110 to 10*b*. Since this negative reference signal 10*b* falls as fast as the input signal 10*a*, as the value of the control signal A1 is reduced, the output signal 20*a*, and, therefore, the flow signal B1 each remain constant. The tachometer signal C1 also remains constant.

When the value of the control signal A1 is reduced below V3, the output of difference amplifier 40 falls below zero, and the two SCR's 100 and 110 open, and, through amplifier 50, SCR 90 closes. The input 30*b* changes from V2 to V1, thereby causing the output of subtractor 30 to change from a small negative value to a small positive value, which is communicated, through SCR 90, to the reference input 10*b*. Thus, the difference between signals 10*a* and 10*b* is suddenly reduced, which, through difference amplifier 20, causes a sudden drop in the output flow signal B1, with the speed of the rotor suddenly decreasing in response thereto until the value of the tachometer signal C1, fed to the reference input 20*b*, is essentially V1. As the value of control signal A1 continues to fall toward V1, the values of signals 10*a* and 10*b* decrease at the same rate, with the result that the rotor speed is constant at the value corresponding to a control signal value equal to V1.

When the value of the control signal A1 reaches V1, the input signals 30*a* and 30*b* are equal, and the reference signal 10*b* becomes zero. As the control signal A1 is further lowered, the output of the subtractor 30 becomes negative and cannot be communicated by either the closed SCR 90 or the open SCR 110. Thus, the reference signal 10*b* remains zero. The value of input signal 10*a* reduces as the value of the control signal A1 drops. The speed of the rotor, controlled by the output flow signal B1, decreases to maintain the tachometer signal C1 at essentially the value of the control signal A1, until the turbine rotor finally stops with A1 going to zero.

In summation, the present invention provides a system for controlling turbine speed by which the speed of the turbine is controlled by a control signal A1 in all ranges of values of A1 except within the range between values V1 and V2, which are selectively adjustable. The range V1 to V2, corresponding to a critical speed interval including the critical speed corresponding to a resonance frequency of a component of the turbine, is divided into lower and upper portions by an intermediate value V3, preferably set about midway between V1 and V2. For any value of the control signal A1 within the lower portion of the range, that is between V1 and V3, the turbine speed is maintained at a value corresponding to a control signal value equal to V1. For any value of the control signal A1 within the upper portion of the range, that is, between V3 and V2, the turbine speed is maintained at a value corresponding to a control signal value equal to V2. As the value of the control signal A1 is increased through V3, the speed of the turbine rapidly shifts from a value corresponding to V1 to a value corresponding to V2. As the value of the control signal A1 is reduced through V3, the speed of the turbine rapidly shifts from a value corresponding to V2 to a value corresponding to V1. Consequently, the turbine speed is rapidly accelerated through the critical speed interval, thereby avoiding any prolonged operation at the turbine's critical speed which can easily be bracketed within the critical speed interval by adjusting the values V1 and V2 as discussed hereinbefore.

It is noted hereinbefore that when control signal A1 exceeds V3, the turbine is rapidly accelerated through the speed interval defined by V1 and V2. However, there is the possibility that operating conditions would limit the rotor speed so that it could not pass all the way through this speed interval bracketing an objectionable critical speed or the like. To protect against this possible condition, the present invention includes a timer which will return the speed of the rotor to that corresponding to V1, unless the rotor speed reaches the value corresponding to V2 in a selected short time. When the timer effects the return to the lower speed, the timer locks the circuit in that condition.

Operation of the timer may be appreciated by further reference to the FIGURE.

The sudden increase in the flow signal B1 to accelerate the rotor through the speed interval is initiated by the control signal exceeding the value V3. Then, B1 is substantially increased from its value corresponding to a control signal equal to V1 to a flow signal value corresponding to a control signal value of V2. As the turbine rotor accelerates in response to the increase in B1, the tachometer signal C1 also increases and, as described hereinbefore, tends to match the effective control signal value, now V2.

The tachometer signal C1 now impresses, through resistor 112, a voltage signal at the input 70*a* of difference amplifier 70 that is larger than the V1 value of the reference voltage 70*b* obtained through the resistor 114. The now positive output voltage from the difference amplifier 70 charges the capacitor 120 as discussed hereinbefore.

The large amplification factor of the difference amplifier 70 and the time constant of the capacitor-resistor combination, 118, 120, 122, causes the capacitor 120 to be charged to a relatively high degree (in excess of V2) in just a few seconds.

If the turbine rotor speed reaches the speed corresponding to a control signal value of V2, the tachometer signal will equal V2. Then, if the tachometer signal increases as the control signal A1 exceeds V2, a negative output signal is produced by the difference amplifier 60, allowing the capacitor 120 to discharge through the diodes 124 and 116. However, if the tachometer signal C1 does not rise soon enough (which would indicate that the turbine rotor speed has not yet passed through the critical speed interval), the voltage signal across the capacitor 120 will exceed the value of A1. The capacitor voltage is communicated through diode 126 to the reference input 40*b*. If the capacitor voltage is thus allowed to exceed the value of A1, the output from the difference amplifier 40 becomes negative, and the SCR's 100 and 110 are opened while SCR 90 is closed. In that instance, the protecting signal 10*b* once again becomes equal to the value which, when combined in subtractor 10 with the control signal A1, causes the input signal 20*a* to be equal to V1. The rotor slows, and the tachometer signal C1 falls to approximately the value of V1, and the capacitor cannot discharge through the diode 116. Then, the capacitor feedback voltage is applied through diode 124 to difference amplifier 70 to lock in the timer signal to the difference amplifier 40 as discussed hereinbefore, thereby keeping SCR 90 closed.

The switch 128 may be closed to dicharge the capacitor 120 to free the difference amplifier 40 to produce a positive output signal to once again close SCR's 100 and 110, and cause SCR 90 to open. This causes the voltage V2 to be impressed at the reference input 30*b* as described hereinbefore, and allows the flow signal B1 to direct the rotor speed to increase.

Thus, while the control unit E1 directs the turbine rotor to accelerate through the critical speed interval, if the rotor does not respond sufficiently rapidly to avoid prolonged operation in the speed interval, the control unit directs the rotor speed to be restored to the value corresponding to a control signal equal to the value V1. The control unit holds the rotor speed at that rotational speed value until the switch 128 is closed, or the control signal A1 is reduced below the value V1.

The timing feature of the control unit E1 is not needed to avoid an inadvertent delay in the deceleration of the rotor speed through the critical speed interval as the control signal A1 is reduced to slow the rotor. Manipulation of the nozzle actuator by reduction of the flow signal B1 effectively reduces the power transmitted to the turbine for rotation of the rotor. Hence, when the control signal A1 falls below the value of V3, the output from the difference amplifier 40 becomes negative, and the protecting signal at 10*b* assumes positive values, as described hereinbefore, to effect the reduction of the tachometer signal C1 to V1.

The timer will not interfere with the rapid reduction of rotor speed through the critical speed interval. While the tachometer signal C1 is greater than V2, the capacitor is discharged through the diode 116. As soon as the tachometer signal falls below the value of V2, discharge of the capacitor 120 through the diode 116 is blocked by a positive output from the difference amplifier 60, and a large voltage is applied at the reference input 40*b*. But this large reference input 40*b* has the same effect to open SCR's 100 and 110, and to cause SCR 90 to close, as does the reduction of the control signal A1 below the value of V3. Consequently, the control unit E1 operates to rapidly decelerate the rotor through the critical speed interval as if the timing feature were absent.

In the application of the control system of the present invention to two or more turbines in series, such as turbines 2 and 3 following in series turbine 1, with turbines 1–3 stationary, and the first control signal A1 equal to zero, the nozzles of turbines 2 and 3 are fully open, and that of turbine 1 is closed. Thus, a positive output flow signal B1 from the first control unit E1 to the first turbine nozzle actuator causes that nozzle to open, while positive output flow signals B2 and B3 from the second and third control units E2 and E3, respectively, cause the nozzles on turbines 2 and 3 to close. This reverse arrangement is used in the turbines following turbines 1 because, with turbines connected in series, opening the nozzle of one turbine reduces the energy spent therein, and increases the energy spent in the other. Thus, if the nozzle of one turbine in a series is opened, that turbine slows down, and the other turbines speed up.

This speed relationship between turbines in series does not prevail at very low rotor speeds, where turbine speed increases with increasing nozzle area. Thus, near zero speed, either increasing or decreasing the nozzle area of a turbine will raise that turbine's speed. Therefore, the nozzles in both following turbines 2 and 3 are fitted with stops to prevent those nozzles from closing to that extent, and, therefore, they are always in the range in which one nozzle opening decreases the speed of that particular turbine and increases the speed of the other. Similarly, if more than just two turbines follow turbine 1 in series, they are also fitted with such nozzle stops, and their respective nozzles tend to close in response to signals from corresponding control units.

As noted hereinbefore, the control signals for the turbines following the first turbine 1 in series are obtained from the tachometer signal C1 of the turbine 1. Thus, as the turbine series is started up with an initial rise in the first control signal A1, turbines 2 and 3 are receiving zero second and third control signals A2 and A3, respectively, and their nozzles are wide open. Since the first tachometer signal C1 is also the reference signal at 20*b*, a large output signal B1 results to open the nozzle of turbine 1. With all the pressure drop occuring in turbine 1, its speed rapidly rises to a level to bring its tachometer signal C1, impressed at 20*b*, into balance with the first control signal A1. The rise in the second and third control signals A2 and A3 accompanying the increase in speed of the first turbine causes large output flow signals B2 and B3 to start closing the nozzles on turbines 2 and 3, respectively. As their respective nozzles are thus partially closed, turbines 2 and 3 begin to rotate, and their speeds build up until their tachometer signals C2 and C3 match their corresponding control signals A2 and A3. Thus, the speeds of turbines 2 and 3 tend to match the speed of turbine 1.

The closure of the nozzles of turbines 2 and 3 causes part of the pressure drop in the driving fluid to be absorbed by turbines 2 and 3. Thus, turbine 1 absorbs less energy and slows down, thereby reducing the reference voltage 20*b*. The slowing of turbine 1 also reduces the subsequent turbine control signals A2 and A3, tending to open the nozzles of turbines 2 and 3. The opening of the nozzles of turbines 2 and 3, along with the increase in the output flow signal B1 due to the reduction in the reference signal 20*b*, tends to increase the speed of turbine 1. Hence, the speeds of the turbines tend to stabilize at the same value, that is, the speed of turbine 1, with all nozzles open substantially the same degree.

This tendency to stabilize and match the speeds of the series of turbines occurs at all speed values, unless the individual control units are adjusted to respond to different critical speed intervals. Each control unit in the series may be adjusted to a critical speed interval, with related intermediate speed, to include the critical speed of that particular turbine if its has such critical speed in its operating speed range. Thus, as the turbine speeds are increased or decreased, each turbine will be temporarily held at the first limit of its critical speed interval and then accelerated through its critical speed interval as the control signal to the corresponding control unit passes the related intermediate speed, as described hereinbefore in the case of a sole turbine. It will be appreciated that each turbine exhibits its own critical speed and, hence, a separate critical speed interval may be selected for each turbine. Some turbines may be held at their respective limit speeds while other turbines are already accelerated across their critical speed intervals.

The use of intermediate signal value V3, corresponding to an intermediate speed for each turbine, also provides an advantage particularly realized in the case of a series of turbines. In the present invention, as the speed of a turbine is increased, for example, the turbine speed is held at the lower limit of the critical speed interval while the control signal value is built up to a point corresponding to a speed about half way through the critical speed interval, the intermediate speed. When that point is reached, the turbine speed is then rapidly increased through the critical speed interval to the upper limit thereof. If the control unit for each turbine in a series is adjusted to a unique critical speed interval corresponding to the related turbine, then each turbine may move through its critical speed interval at a time different from such activity by the other turbines. However, as a given turbine does rapidly change speed of operation, its nozzle adjustment affects the pressure drops across the other turbines in the series, causing changes in the other turbine speeds. If a turbine is made to hesitate at the lower limit of its critical speed interval until its control signal moves to the upper limit of that interval rather than the intermediate value as described hereinbefore, the speeds of the other turbines in the series would be increased considerably correspondingly. Then, when the speed of the turbine in question is quickly increased to the value above its critical speed interval, the speeds of the other turbines would drop considerably in response, resulting in considerable speed swings. Thus, by providing the intermediate signal as the point at which the individual turbines cross their critical speed intervals, the present invention cuts the speed upset of the other turbines in the series approximately in half.

There is the possibility that a given turbine exhibits more than one critical speed. A control unit of the present invention may be constructed to prevent prolonged operation of a turbine at each of its multiple critical speeds by defining the critical speed interval large enough to include more than one critical speed, or by including in the control unit the means for defining multiple critical speed intervals to include all the critical speeds to be avoided.

In the FIGURE, all of the components within the control unit E1, with the exception of the subtractor 10 and the difference amplifier 20, constitute a protecting signal generator circuit. This protector circuit not only defines the critical speed interval, but supplies the protecting signal (to the reference input **10*b***) necessary to hold the rotor speed, then accelerate it through the critical speed interval. Where a turbine exhibits two or more critical speeds within the normal operating speed range such that the critical speeds cannot be conveniently avoided by enclosing them within a single critical speed interval, additional critical speed intervals may be defined, complete with provisions for generating appropriate protecting signals, by the addition of a separate protecting signal generating circuit for each critical speed as needed. Additional turbines in series may each have a control unit with a single protector circuit or with multiple protector circuits.

All of the protector circuits within a control unit, such as E1, are arranged in parallel. Each protector circuit output signal (protecting signal) is zero when the control signal does not fall within the limit voltages defining the critical speed interval for the corresponding protector circuit. In such case, the resistance of the protector circuit is high. This resistance of a protector circuit is much lower when the control signal falls within the limit voltages of that particular protector circuit. Consequently, connecting two or more such protecting circuits in parallel does not interfere with the operation of any one such protector circuit. Each protector circuit individually performs as described hereinbefore to protect the rotor against prolonged operation at the respective critical speed.

It will be appreciated that the construction of the apparatus involved with the present invention, as well as the manner of generating the protecting signals and flow signals may be varied within the scope of the present invention. Thus, for example, the inputs to the difference amplifiers 10 and 20 may be reversed in each case, to produce negative signals where positive signals are generated according to the circuit illustrated. Similarly, the circuitry described to generate the protecting signal **20*b*** may be varied to determine the critical speed interval and the intermediate speed in any appropriate manner.

The foregoing disclosure and description of the invention is illustrative and explanatory thereof, and various changes in the method steps as well as the details of the illustrated apparatus may be made within the scope of the appended claims without departing from the spirit of the invention.

We claim:

1. A method of controlling fluid-driven systems, wherein the driving fluid is communicated to said systems through nozzles adjustable to determine the speed of operation of said systems, comprising the following steps:

(a) providing a control signal for controlling the speed of operation of such system;

(b) providing a speed signal, generated to correspond to the speed of operation of said system;

(c) generating a flow signal, based on said control signal and said speed signal, for controlling the nozzle of said system to effect the speed of operation of said system corresponding to said control signal;

(d) determining a critical speed interval, identified by a first control signal value and a second control signal value, and determining an intermediate control signal value corresponding to a speed of operation of said system within said critical speed interval;

(e) generating a protecting signal whenever the value of said control signal is within said critical speed interval such that, for values of said control signal between said first control signal value and said intermediate control signal value, said protecting signal value is determined by the difference between said value of said control signal and said first control signal value and, for values of said control signal between said intermediate control signal value and said second control signal value, said protecting signal value is determined by the difference between said value of said control signal and said second control signal value; and (f) generating said flow signal, when the value of said control signal is within said critical speed interval, based on a first difference between said control signal and said protecting signal, and on a second difference between said first difference and said speed signal.

2. A method as defined in claim 1 further comprising the additional steps of:

(g) using said speed signal as the control signal for at least one additional fluid-driven system operating in series following the former fluid-driven system;

(h) generating a speed signal corresponding to the speed of operation of each such following system; and (i) generating a flow signal for each such following system based on said speed signal of said former system, so used as a control signal for said following systems, and the speed signal corresponding to each said following system, for controlling the nozzle of each said following system to effect the speed of operation of said systems corresponding to their respective control signals.

3. A method as defined in claim 2 further comprising the additional steps of carrying out the steps (d) through (f) of claim 1 for each said following system.

4. A method as defined in claim 3 wherein each such critical speed interval includes one or more critical speeds of the corresponding system.

5. A method as defined in claim 1 further comprising the additional step of providing a timing signal such that whenever the value of said control signal is being increased beyond said intermediate control signal value said timing signal operates to cause said protecting signal value to be determined by the difference between said value of said control signal and said first control signal value if, after the value of said control signal is increased beyond said intermediate control signal value, said speed signal does not increase to a value corresponding to said second control signal value within a time determined by said timing signal.

6. A method as defined in claim 5 further comprising the additional step of locking said timing signal to retain said protecting signal value being so determined by the difference between said value of said control signal and said first control signal value.

7. A method as defined in claim 6 further comprising the additional steps of:

(g) using said speed signal as the control signal for at least one additional fluid-driven system operating in series following the former fluid-driven system;

(h) generating a speed signal corresponding to the speed of operation of each such following system; and (i) generating a flow signal for each such following system based on said speed signal of said former system, so used as a control signal for said following systems, and the speed signal corresponding to each said following system, for controlling the nozzle of each said following system to effect the speed of operation of said systems corresponding to their respective control signals.

8. A method as defined in claim 1 further comprising the additional steps of carrying out the steps (d) through (f) of claim 1 for at least one additional critical speed interval.

9. A method of controlling the speed of operation of a turbine, wherein said speed may be controlled by selective adjustment of a nozzle communicating drive fluid, comprising the following steps:

(a) providing a selectively adjustable control signal;

(b) providing a speed signal, generated to correspond to the speed of operation of said turbine;

(c) determining at least one critical speed interval, wherein each such critical speed interval is identified by a corresponding first control signal limit value and a corresponding second control signal limit value, and determining a separate intermediate control signal value corresponding to a speed of operation of said turbine within each said critical speed interval;

(d) generating a protecting signal that is non-zero whenever the value of said control signal is within any said critical speed interval such that, for values of said control signal between the first control signal limit value and the intermediate control signal value corresponding to such a critical speed interval, said protecting signal value is determined by the difference between said value of said control signal and said corresponding first control signal limit value, and, for values of said control signal between the intermediate control signal value and the second control signal value corresponding to such a critical speed interval, said protecting signal value is determined by the difference between said value of said control signal and said corresponding second control signal limit value, said protecting signal being zero otherwise; and (e) generating a flow signal based on a first difference between said control signal and said protecting signal and on a second difference between said first difference and said speed signal for controlling the nozzle of said turbine to effect the speed of operation of said turbine corresponding to said control signal.

10. A method as defined in claim 9 further comprising the additional step of providing a timing signal for each such critical speed interval such that whenever said control signal is being increased beyond the corresponding intermediate control signal value of such a critical speed interval, said timing signal operates to cause the protecting signal value to be determined by the difference between said value of said control signal and said first control signal limit value if, after said control signal value is increased beyond the corresponding intermediate control signal value, said speed signal does not increase to a value equal to the corresponding second control signal limit value within a time determined by said timing signal.

11. A method as defined in claim 10 further comprising the additional step of locking the timing signal so operating to retain said protecting signal value being so determined by the difference between said value of said control signal and said first control signal limit value.

12. A method of controlling the speeds of operation of a plurality of turbines, arranged to operate in series and including a first turbine in said series and one or more following turbines in said series, wherein the speed of operation of each such turbine is controllable by adjustable nozzle means, comprising the following steps:

(a) providing a selectively adjustable first control signal;

(b) generating, for each turbine, a speed signal corresponding to the speed of operation of said respective turbine;

(c) using the speed signal of said first turbine as a following control signal for each of said one or more following turbines;

(d) determining, for each turbine, a critical speed interval, identified by a first control signal limit value and a second control signal limit value for that turbine, and further determining an intermediate control signal value between said first and second control signal limit values for each turbine;

(e) generating, for each turbine, a protecting signal, whenever the corresponding control signal is within the corresponding critical speed interval, such that the protecting signal value is determined by the difference between said corresponding control signal and the corresponding first control signal limit value when the value of said control signal is between said first control signal limit value and the corresponding intermediate control signal value, and said protecting signal value is determined by the difference between said control signal and said second corresponding control signal limit value when the value of said control signal is between said intermediate control signal value and said second control signal limit value; and (f) comparing for each turbine, the corresponding control signal with the corresponding protecting signal to obtain a first difference signal, comparing said first difference signal with the corresponding speed signal and generating a flow signal, corresponding to the difference therebetween, for controlling said nozzle means of said corresponding turbine to effect the speed of operation of said turbine corresponding to said corresponding control signal.

13. A method as defined in claim 12 further comprising the additional step of providing a timing signal for each critical speed interval such that whenever the corresponding control signal is being increased beyond the corresponding intermediate control signal value of such a critical speed interval, said timing signal operates to cause the corresponding protecting signal value to be determined by the difference between said value of said control signal and said first control signal limit value if, after said control signal value is increased beyond the corresponding intermediate control signal value, the corresponding speed signal does not increase to a value equal to the corresponding second control signal limit value within a time determined by said timing signal.

14. A method as defined in claim 13 further comprising the additional step of locking each timing signal so operating to retain the corresponding protecting signal value being so determined by the difference between said value of said corresponding control signal and said corresponding first control signal limit value.

15. A method as defined in claim 12 wherein each such critical speed interval includes one or more critical speeds of the corresponding turbine.

16. A method as defined in claim 12 further comprising the additional steps of:

(a) determining one or more additional critical speed intervals and corresponding intermediate control signal values for at least one turbine, as defined in claim 12;

(b) generating a corresponding protecting signal, as defined in claim 12, for each such additional critical speed interval; and (c) using said protecting signal for each such additional critical speed interval for generating a flow signal as defined in claim 12.

17. Apparatus for controlling the speed of operation of a turbine, propelled by a driving fluid communicated through nozzle means whereby said speed of operation is controllable by selectively adjusting said nozzle means, comprising:

(a) control unit means for receiving a control signal and for generating a flow signal for selectively adjusting said nozzle means;

(b) speed signal generation means, for generating a speed signal proportional to the speed of operation of said turbine and communicating said speed signal to said control unit means;

(c) first signal processing means, as part of said control unit means, for comparing said control signal with a predetermined critical signal value range defined by a first limit value and a second limit value, and with a predetermined intermediate signal value between said first and second limit values, and for generating a protecting signal whereby the value of said protecting signal is zero whenever the value of said control signal is outside said critical signal value range, and the value of said protecting signal is proportional to the difference between said control signal value and said first limit value when the value of said control signal is between said first limit value and said intermediate signal value, and the value of said protecting signal is proportional to the difference between said control signal value and said second limit value when the value of said control signal is between said intermediate signal value and said second limit value; and (d) second signal processing means for comparing said control signal with said protecting signal and producing a first difference signal proportional to the difference therebetween, and for comparing said first difference signal with said speed signal to so generate said flow signal proportional to the difference therebetween.

18. Apparatus as defined in claim 17 wherein said first signal processing means further comprises timing signal generation means for producing a timing signal, whenever said control signal is being increased beyond said intermediate signal value, for causing said protecting signal value to be determined by the difference between said control signal value and said first limit value if, after said control signal value is increased beyond said intermediate signal value, said speed signal does not increase to a value corresponding to said second limit value within a time determined by said timing signal generation means.

19. Apparatus as defined in claim 18 wherein said timing signal generation means further comprises locking means for causing said timing signal to retain said protecting signal value being determined by the difference between said control signal value and said first limit value.

20. Apparatus as defined in claim 17 further comprising one or more additional first signal processing means as defined in claim 17, defining at least one different critical signal value range and each generating a protecting signal, and wherein said control signal is compared with each such protecting signal to produce said first difference signal.

21. Apparatus for controlling the speeds of operation of a plurality of turbines, propelled by driving fluid communicated through nozzle means, arranged to operate in series and including a first turbine in said series and one or more following turbines in said series, wherein the speed of operation of each such turbine is controllable by adjustable nozzle means, comprising:

(a) first control unit means for receiving a first control signal and for generating a first flow signal for selectively adjusting said nozzle means of said first turbine, and wherein said first control unit means:

(i) defines a critical speed interval, identified by a first limit value and a second limit value, and including an intermediate signal value between said first and second limit values;

(ii) generates a protecting signal whenever the value of said first control signal is within said critical speed interval such that, when the value of said first control signal is between said first limit value and said intermediate signal value, the value of said protecting signal is proportional to the difference between the value of said first control signal and said first limit value, and such that, when the value of said first control signal is between said intermediate signal value and said second limit value, the value of said protecting signal is proportional to the difference between the value of said control signal and said second limit value, the value of said protecting signal being zero when the value of said first control signal is outside said critical speed interval; and (iii) produces a first difference signal proportional to the difference between the value of said first control signal and said protecting signal;

(b) additional control unit means for each said following turbine wherein each such control unit means may receive a control signal and generate a flow signal for adjusting said nozzle means of the corresponding turbine;

(c) first speed signal generation means for generating a first speed signal corresponding to the speed of operation of said first turbine;

(d) wherein said first speed signal is received by said additional control unit means of said following turbines as a control signal; and (e) wherein said first control unit means so generates said first flow signal proportional to the difference between said first difference signal and said first speed signal.

22. Apparatus for controlling the speeds of operation of a plurality of turbines, propelled by driving fluid communicated through nozzle means, arranged to operate in series and including a first turbine in said series and one or more following turbines in said series, wherein the speed of operation of each such turbine is controllable by adjustable nozzle means, comprising:

(a) first control unit means for receiving a first control signal and for generating a first flow signal for selectively adjusting said nozzle means of said first turbine;

(b) additional control unit means for each said following turbine wherein each such additional control unit means may receive a control signal and generate a flow signal for adjusting said nozzle means of the corresponding turbine;

(c) speed signal generation means for generating a speed signal corresponding to the speed of operation of each turbine, including a first speed signal corresponding to the speed of operation of said first turbine, which first speed signal is received by each said additional control unit means of said following turbines as a control signal;

(d) wherein each said control unit means:

(i) defines a critical speed interval for the corresponding turbine, identified by a first limit value and a second limit value for the corresponding turbine, and including an intermediate signal value between said first and second limit values;

(ii) generates a protecting signal whenever the value of the corresponding control signal for such turbine is within the critical speed interval for said turbine such that, when the value of said corresponding control signal is between said corresponding first limit value and said corresponding intermediate signal value for such turbine, the value of said protecting signal for said turbine is proportional to the difference between said control signal value and said first limit value, and such that, when said control signal value is between said intermediate signal value and said corresponding second limit value for such turbine, the value of said protecting signal is proportional to the difference between said control signal value and said second limit value, the value of said protecting signal being zero when said control signal value is outside said critical speed interval for said turbine;

(iii) produces a first difference signal proportional to the difference between said corresponding control signal value and said corresponding protecting signal; and (iv) so generates said corresponding flow signal proportional to the difference between said corresponding first difference signal and said corresponding speed signal.

23. Apparatus as defined in claim 21 wherein said first control unit means further generates a timing signal, whenever said first control signal is being increased beyond said intermediate signal value, for causing said protecting signal value to be determined by the difference between said first control signal value and said first limit value if, after said first control signal value is increased beyond said intermediate signal value, said first speed signal does not increase to a value corresponding to said second limit value within a time determined by said timing signal.

24. Apparatus as defined in claim 23 wherein said first control unit means further comprises locking means for causing said timing signal to retain said protecting signal value being determined by the difference between said first control signal value and said first limit value.

25. Apparatus as defined in claim 21 wherein said first control unit means further defines one or more additional critical speed intervals, as defined in claim 21, and generates a protecting signal for each such additional critical speed interval, as defined in claim 21, and produces said first difference signal proportional to the difference between said first control signal value and the combination of all said protecting signals.

26. Apparatus as defined in claim 22 wherein each said control unit means further generates a corresponding timing signal, whenever said corresponding control signal is being increased beyond the intermediate signal value of said corresponding critical speed interval, for causing said corresponding protecting signal value to be determined by the difference between said control signal value and said corresponding first limit value if, after said control signal value is increased beyond said intermediate signal value, the corresponding speed signals does not increase to a value equal to said corresponding second limit value within a time determined by said timing signal.

27. Apparatus as defined in claim 26 wherein each said control unit means further comprises locking means for causing said corresponding timing signal to retain said corresponding protecting signal value being determined by the difference between said corresponding control signal value and said corresponding first limit value.

28. Apparatus as defined in claim 22 wherein one or more said control unit means further defines one or more additional critical speed intervals, as defined in claim 22 and generates a protecting signal for each such additional critical speed interval, as defined in claim 22, and produces the corresponding first difference signal proportional to the difference between the corresponding control signal value and the combination of all said corresponding protecting signals.

29. A method as defined in claim 7 further comprising carrying out for each of said following systems the additional steps of:

(j) determining a critical speed interval for each said following system, identified by a first control signal value and a second control signal value for said following system, and determining an intermediate control signal value for said following system corresponding to a speed of operation of said following system within said critical speed interval;

(k) generating a protecting signal for said following system whenever the value of said control signal for said following system is within said critical speed interval of said following system such that, for values of said control signal between said first control signal value and said intermediate control signal value, said protecting signal value is determined by the difference between said value of said control signal and said first control signal value and, for values of said control signal between said intermediate control signal value and said second control signal value, said protecting signal value is determined by the difference between said value of said control signal and said second control signal value;

(l) generating a flow signal for each such following system, when the value of said control signal for said following system is within said critical speed interval of said following system, based on a first difference between said control signal for said following system and said protecting signal of said following system, and on a second difference between said first difference and said speed signal of said following system;

(m) providing a timing signal for said following system such that whenever the value of said control signal for said following system is being increased beyond said intermediate control signal value for said following system, said timing signal operates to cause said protecting signal value for said following system to be determined by the difference between said value of said control signal and said first control signal value for said following system if, after the value of said control signal is increased beyond said intermediate control signal value, the speed signal of said following system does not increase to a value corresponding to said second control signal value for said following system within a time determined by said timing signal; and (n) locking said timing signal of said following system to retain said protecting signal value being so determined by the difference between said value of said control signal for said following system and said first control signal value of said following system.

30. A method as defined in claim 29 further comprising carrying out for said former system and for each of said following systems the additional steps of:

(o) determining at least one additional critical speed interval for each such system identified by a first control signal value and a second control signal value for each such critical speed interval, and determining an intermediate control signal value corresponding to a speed of operation of said corresponding system within each such critical speed interval;

(p) generating a protecting signal for each such system whenever the value of said control signal for each such system is within such a critical speed interval for said system such that, for values of said control signal for such system between the first control signal value and the intermediate control signal value of such critical speed interval for said system, said protecting signal value for said system is determined by the difference between said value of said control signal for said system and said first control signal value of said critical speed interval, and for values of said control signal for said system between said intermediate control signal value and said second control signal value of said critical speed interval, said protecting signal value is determined by the difference between said value of said control signal and said second control signal value;

(q) generating a flow signal for each said system, when the value of said control signal for said system is within a critical speed interval of said system, based on a first difference between said control signal and said protecting signal of said system, and on a second difference between said first difference and said speed signal of said system;

(r) providing a timing signal for each such system such that whenever the value of the control signal for such a system is being increased beyond the intermediate control signal value of such a critical speed interval for said system said timing signal for said system operates to cause the protecting signal value of said system to be determined by the difference between the value of said control signal and the first control signal value of said critical speed interval if, after the value of said control signal is increased beyond said intermediate control signal value, the speed signal of said system does not increase to a value corresponding to the second control signal value of said critical speed interval within a time determined by said timing signal; and (s) locking the timing signal of each such system to retain the value of the protecting signal for said system being so determined by the difference between said value of said control signal for said system and the first control signal value of such critical speed interval of said system.

31. A method as defined in claim 6 further comprising the additional steps of:

(g) determining at least one additional critical speed interval, identified by a first control signal value and a second control signal value for each such additional critical speed interval, and determining an intermediate control signal value corresponding to a speed of operation of said system within each such additional critical speed interval;

(h) generating a protecting signal whenever the value of said control signal is within such additional critical speed interval such that, for values of said control signal between said first control signal value and said intermediate control signal value of such additional critical speed interval, said protecting signal value is determined by the difference between said value of said control signal and said first control signal value and, for values of said control signal between said intermediate control signal value and said second control signal value of such additional critical speed interval, said protecting signal value is determined by the difference between said value of said control signal and said second control signal value;

(i) generating said flow signal, when the value of said control signal is within such additional critical speed interval, based on a first difference between said control signal and said protecting signal, and on a second difference between said first difference and said spaced signal;

(j) providing a timing signal such that whenever the value of said control signal is being increased beyond said intermediate control signal value for such additional critical speed interval said timing signal operates to cause said protecting signal value to be determined by the difference between said value of said control signal and said first control signal value of said additional critical speed interval if, after said control signal value is increased beyond said intermediate control signal value, said speed signal does not increase to a value corresponding to said second control signal value of said additional critical speed interval within a time determined by said timing signal; and (h) locking said timing signal to retain said protecting signal value being so determined by the difference between said value of said control signal and said first control signal value of such additional critical speed interval.

* * * * *

UNITED STATES PATENT AND TRADEMARK OFFICE

CERTIFICATE OF CORRECTION

PATENT NO. : 4,173,870

DATED : November 13, 1979

INVENTOR(S) : Judson S. Swearingen

It is certified that error appears in the above-identified patent and that said Letters Patent are hereby corrected as shown below:

In Claim 31, Column 25, line 4, after the word "said", delete the word "spaced", and insert therefor --speed--.

Signed and Sealed this

Second Day of June 1981

[SEAL]

Attest:

RENE D. TEGTMEYER

Attesting Officer

Acting Commissioner of Patents and Trademarks